US010813415B2

(12) United States Patent
Lee et al.

(10) Patent No.: US 10,813,415 B2
(45) Date of Patent: Oct. 27, 2020

(54) MAGNETIC ASSEMBLY STRUCTURE

(71) Applicant: TAIWAN OASIS TECHNOLOGY CO., LTD., New Taipei (TW)

(72) Inventors: Wei-Long Lee, New Taipei (TW); Shih-Meng Liao, New Taipei (TW)

(73) Assignee: TAIWAN OASIS TECHNOLOGY CO., LTD., New Taipei (TW)

( * ) Notice: Subject to any disclaimer, the term of this patent is extended or adjusted under 35 U.S.C. 154(b) by 84 days.

(21) Appl. No.: 16/014,180

(22) Filed: Jun. 21, 2018

(65) Prior Publication Data

US 2019/0387845 A1 Dec. 26, 2019

(51) Int. Cl.

| | |
|---|---|
| ***A44B 11/25*** | (2006.01) |
| ***H01F 7/20*** | (2006.01) |
| ***H01F 7/02*** | (2006.01) |

(52) U.S. Cl.

CPC ..... *A44B 11/2588* (2013.01); *H01F 7/0231* (2013.01); *H01F 7/20* (2013.01); *A44D 2203/00* (2013.01)

(58) Field of Classification Search

CPC ..... A44B 11/2588; H01F 7/0231; H01F 7/20

USPC ..... 24/303

See application file for complete search history.

(56) References Cited

U.S. PATENT DOCUMENTS

| | | | | |
|---|---|---|---|---|
| 3,520,033 | A * | 7/1970 | Usuda Genji | A44B 11/2588 24/590.1 |
| 6,292,985 | B1 * | 9/2001 | Grunberger | A44B 11/2592 24/303 |
| 9,961,966 | B2 * | 5/2018 | Ryan | A44B 1/20 |
| 10,070,697 | B1 * | 9/2018 | Melgoza | A44C 1/00 |
| 2002/0000024 | A1 * | 1/2002 | Grunberger | A44B 11/2592 24/303 |
| 2010/0325844 | A1 * | 12/2010 | Fiedler | A44B 11/25 24/303 |
| 2011/0138583 | A1 * | 6/2011 | Fiedler | A44B 11/25 24/303 |
| 2017/0172262 | A1 * | 6/2017 | Paik | A44B 11/2592 |
| 2018/0160779 | A1 * | 6/2018 | Fildan | A44B 11/2588 |
| 2018/0368533 | A1 * | 12/2018 | Chan | A44B 11/2592 |
| 2019/0069648 | A1 * | 3/2019 | Duncan | A44C 5/2071 |

* cited by examiner

*Primary Examiner* — Jason W San

(74) *Attorney, Agent, or Firm* — Demian K. Jackson; Jackson IPG PLLC

(57) ABSTRACT

The present disclosure relates to a magnetic assembly structure which utilizes a magnetic attraction or repulsion effect generated by two magnetic components to make two buckle structures automatically engaged to each other. The magnetic assembly structure of the present disclosure has a first main body and a second main body, and via the hardware design of disposing magnetic components and buckle structures respectively on the first main body and the second main body, the first and second main bodies rotate in respect to each other due to the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced.

23 Claims, 11 Drawing Sheets

MAGNETIC ASSEMBLY STRUCTURE

BACKGROUND

1. Technical Field

The present disclosure relates to a magnetic assembly structure, in particular, to a magnetic assembly structure which utilizes a magnetic attraction or repulsion effect generated by two magnetic components to make two buckle structures automatically engaged to each other.

2. Description of Related Art

Generally, to assemble two main bodies to an object, a screwing way can be used by screws, or an engaging or snapping way can be used by buckle structures. For example, a thermos cup has a cup body and a cup cover, which respectively have a male screw and female screw, and thus a rotating way can be used to snap the male screw and the female screw. Usually, a left hand is used to hold the cup body, and a right hand is used to rotate the cup cover, by the way of snapping the male screw and the female screw and rotating the cup cover in respect to the cup body, the cup cover is screwed to the cup body, such that the water in the thermos cup will not leak out. However, when the left hand is used to hold one other object, being unable to hold the cup body, the cup cover is therefore unable to be screwed to the cup body; or alternatively, the one other object should be laid aside to make the left hand free to hold the cup body; or alternatively, a help of one other person for holding the cup body is required. Similarly, when rotating the cup cover to leave from the cup body, it faces the abovementioned problems.

For another example, mentioned in TW Patent M548766, one projection lamp is provided, comprising a lamp case, a glass plate (i.e. lamp mask) and a buckle unit, and the buckle unit is used to engage the glass plate to the lamp case. Such manner not only needs the independent buckle unit, the left hand for holding the lamp case and the right hand for holding the glass plate, but also needs a help of one other person for simultaneously engaging the buckle unit to the lamp case and the glass plate. Similarly, when uninstalling the projection lamp to exchange the inner component, a help of one other person for detaching the buckle unit is also required.

Taking a ceiling lamp for another example, the ceiling lamp comprises a lamp base and a lamp mask. The installation of the ceiling lamp is to use a screw to penetrate screw holes disposed on the lamp base and the lamp mask, and then to screw them tightly. However, such installation has the following disadvantages: (1) it is very troublesome that the screw is screwed tightly after the two screw holes disposed on the lamp base and the lamp mask must be aligned precisely; (2) since the lamp mask is usually made of by glass and has a certain degree of weight, the hand or holding the lamp mask is required when aligning the screw holes, which not only needs a strong force, but also ease the lamp mask to fall down to cause a danger. Similarly, when uninstalling the lamp mask, the left hand for hold the lamp mask and the right hand for rotating the screw are also needed, thus consuming force and causing unsafety.

According to the technical features in the mentioned related art, whenever installing and uninstalling the thermos cup, the projection lamp and the ceiling lamp, two hands are required to operate simultaneously, even a help of one other person is required for achieving the installation and uninstallation, which causes time consuming, force consuming, inconvenience and unsafety.

Therefore, how to ease the installation and uninstallation of an apparatus by a novel hardware design and how to efficiently reduce the installation cost and expensing time are still the issues which the industrial developer and related research and design person continuously try to overcome and solve.

SUMMARY

One objective of the present disclosure is to provide a magnetic assembly structure, in particular, a magnetic assembly structure which utilizes a magnetic attraction or repulsion effect generated by two magnetic components to make two buckle structures automatically engaged to each other. Therefore, it actually eases the installation and uninstallation of the appliance to which the magnetic assembly structure is applied, and the costs of installation and consuming time are reduced.

According to one objective of the present disclosure, applicant provides a magnetic assembly structure, at least comprising: a first main body, comprising at least one first buckle structure; and a second main body, comprising at least one second buckle structure; wherein the second main body and the first main body mutually generate a magnetic attraction or repulsion effect, so as to rotate the second main body and first main body in respect to each other, thereby engaging the second buckle structure and the first buckle structure each other.

Regarding the above magnetic assembly structure, the second buckle structure is a magnetic component is a magnetic component, and the first buckle structure is another magnetic component, such that the second buckle structure and the first buckle structure mutually generate the magnetic attraction or repulsion effect.

Regarding the above magnetic assembly structure, the first main body further comprises at least one first magnetic component.

Regarding the above magnetic assembly structure, the second buckle structure is a magnetic component, such that the first magnetic component and the second buckle structure mutually generate the magnetic attraction or repulsion effect.

Regarding the above magnetic assembly structure the second main body further comprises at least one second magnetic component, such that the second magnetic component and the first magnetic component mutually generate the magnetic attraction or repulsion effect.

Accordingly, the magnetic assembly structure of the present disclosure, via the hardware design of disposing magnetic components and buckle structures respectively on the first main body and the second main body, makes the first and second main bodies rotate in respect to each other due to the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced.

BRIEF DESCRIPTION OF THE DRAWINGS

The accompanying drawings are included to provide a further understanding of the present disclosure, and are incorporated in and constitute a part of this specification.

The drawings illustrate exemplary embodiments of the present disclosure and, together with the description, serve to explain the principles of the present disclosure.

DESCRIPTION OF THE EXEMPLARY EMBODIMENTS

Figure 1:
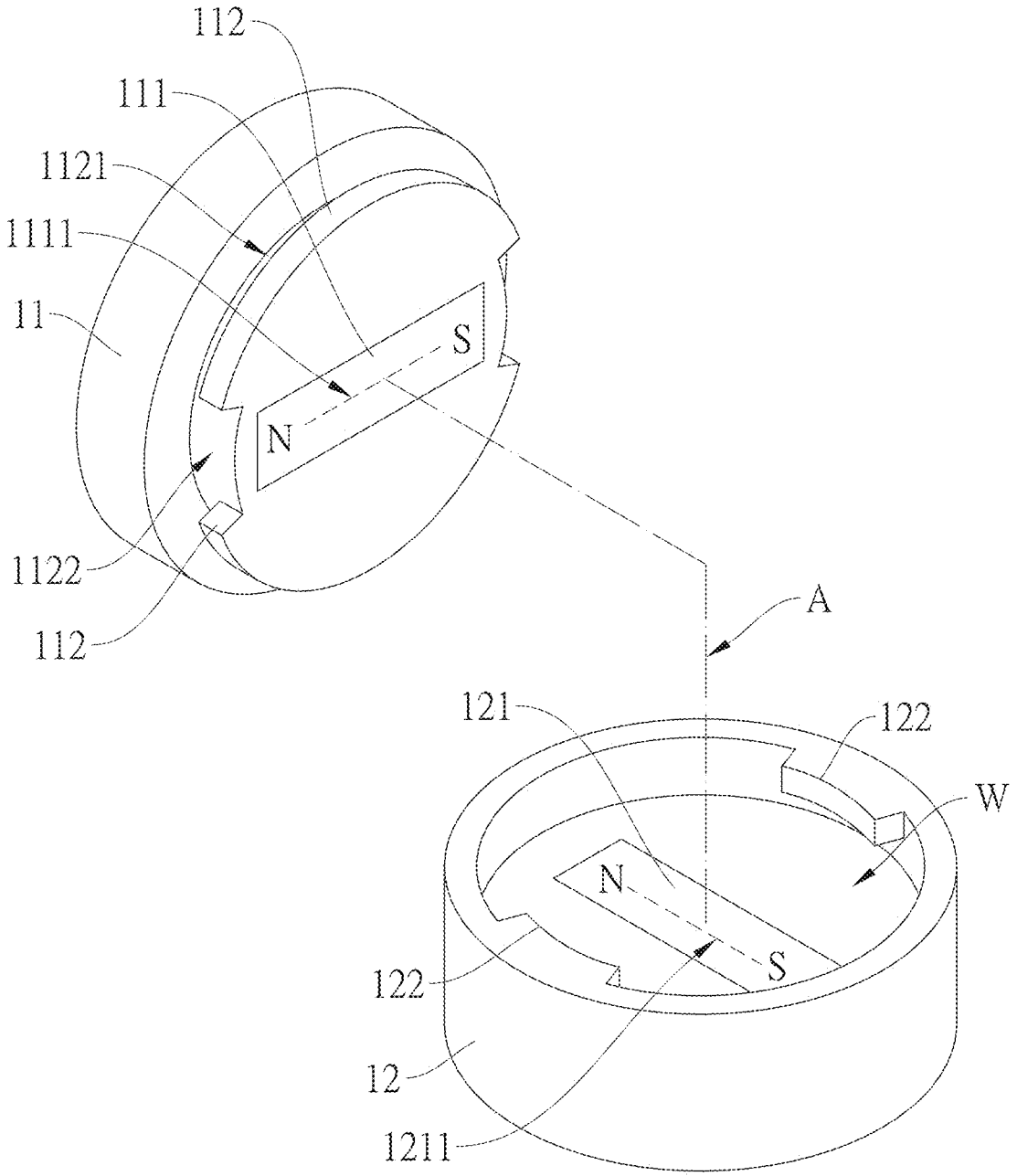
FIG. 1 is an explosive diagram of a magnetic assembly structure according to a first embodiment of the present disclosure.

To facilitate understanding of the present disclosure, the following descriptions are provided to illustrate exemplary embodiments of the present disclosure together with drawings. It is noted that the following drawings are used for illustration of the present disclosure and not intended to limit the actual dimension, ratio and alignment. Therefore, ratios and allocations of the components in the drawings will not limit the scope of the present disclosure.

Firstly, referring to FIG. 1, FIG. 2A, FIG. 2B, FIG. 3A and FIG. 3B, as shown in such drawings, the magnetic assembly structure (1) of the present disclosure at least comprises a first main body (11) and a second main body (12).

The first main body (11) comprises at least one first magnetic component (111) and at least one first buckle structure (112). In one preferred embodiment, the first magnetic component (111) is formed in a square shape, a rectangular shape, a U-shape or a circular shape, and an N pole and a S pole of the first magnetic component (111) are disposed on the two ends of the rectangle, for example, the N and S poles of the first magnetic component (111) are disposed on the two ends of the long axis of the rectangle. A connection line of the N and S poles of the first magnetic component (111) form a first magnetic axis (1111). The first buckle structure (112) is disposed at one of the right and left sides of the first magnetic component (111), or the first buckle structure (112) is disposed at one of the right and left sides of the first magnetic axis (1111). In the embodiment, the first buckle structure (112) is a protrusion edge, and top of the first buckle structure (112) is formed with a groove (1121). A tail terminal of the first buckle structure (112) is formed with a notch (1122), and the groove (1121) communicates with the notch (1122). Preferably, the first main body (11) comprises the first magnetic component (111) and the two first buckle structures (112), and the two first buckle structures (112) are respectively and symmetrically disposed at the left and right sides of the first magnetic component (111), or the two first buckle structures (112) are respectively and symmetrically disposed at the left and right sides of the first magnetic axis (1111). The first buckle structure (112) are disposed with a gap to form the two notches (1122) being symmetrical to each other. The first buckle structure (112) can be disposed on any position of the first main body (11). Preferably, the first buckle structure (112) is disposed at the edge of the first main body (11). Further preferably, the first buckle structure (112) is disposed at the edge of the bottom side of the first main body (11).

The second main body (12) comprises at least one second magnetic component (121) and at least one second buckle structure (122). Similar to the first main body (11), the second magnetic component (121) is formed in a square shape, a rectangular shape, a U-shape or a circular shape, and an N pole and a S pole of the second magnetic component (121) are disposed on the two ends of the rectangle, for example, the N and S poles of the second magnetic component (121) are disposed on the two ends of the long axis of the rectangle. A connection line of the N and S poles of the second magnetic component (121) form a second magnetic axis (1211). The second buckle structure (122) is disposed at one of the right and left sides of the second magnetic component (121), or the second buckle structure (122) is disposed at one of the right and left sides of the second magnetic axis (1211). In the embodiment, the second buckle structure (122) is a protrusion block. Preferably, the second main body (12) comprises the second magnetic component (121) and the two second buckle structures (122), and the two second buckle structures (122) are respectively and symmetrically disposed at the left and right sides of the second magnetic component (121), or the two second buckle structures (122) are respectively and symmetrically disposed at the left and right sides of the second magnetic axis (1211). The second buckle structure (122) can be disposed on any position of the second main body (12). Preferably, the second buckle structure (122) is disposed at the edge of the second main body (12). Further preferably, the second buckle structure (122) is disposed at the edge of the top side of the second main body (12).

The second buckle structure (122) is capable of penetrating through the notch (1122), and the width of the protrusion block is less than that of the notch (1122), such that the protrusion block is capable of penetrating through the notch (1122). The second buckle structure (122) can be accommodated in the groove (1121), and for example, when the thickness of the protrusion block is less than or equal to the width of the groove (1121), the protrusion block is capable of moving within the groove (1121).

When the first main body (11) and the second main body (12) mutually close to assemble and form a magnetic assembly structure (1), the second magnetic component (121) and the first magnetic component (111) mutually generate the magnetic attraction effect to rotate the second main body (12) and first main body (11) in respect to each other, thereby engaging the second buckle structure (122) and the first buckle structure (112) each other. In addition, the first main body (11) and the second main body (12) are rotated in respect to each other via a rotation axis (A), wherein the rotation axis (A) is a connection line of a central of the first magnetic component (111) and a central of the second magnetic component (121), a central of the first main body (11), a central of the second main body (12) or a connection line of the central of the first main body (11) and the central of the second main body (12).

Figure 2A:
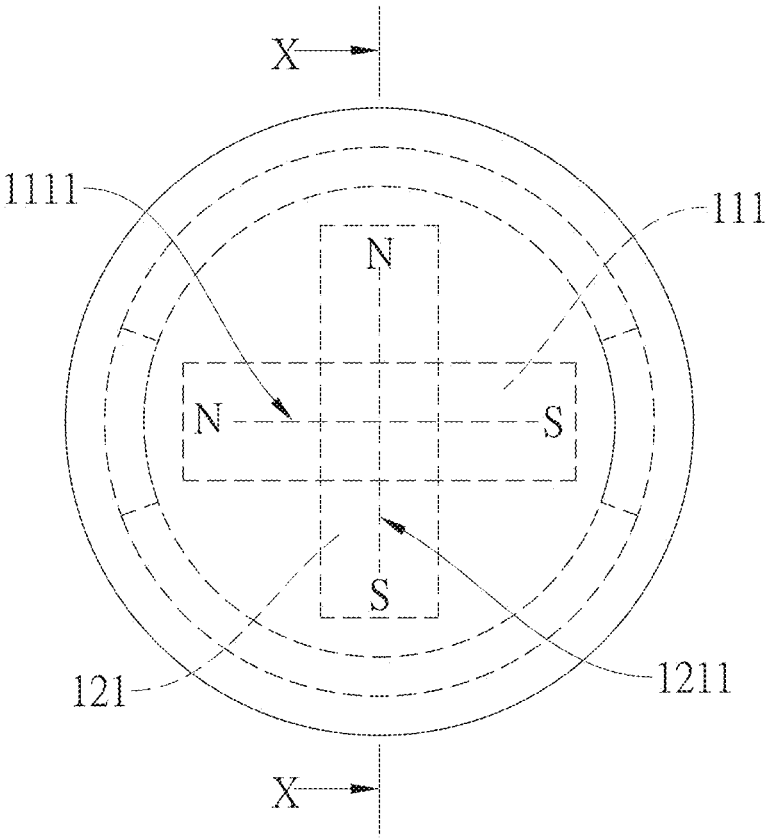
FIG. 2A is a schematic diagram showing the first main body and second main body of the magnetic assembly structure mutually close according to the first embodiment of the present disclosure.
Figure 2B:
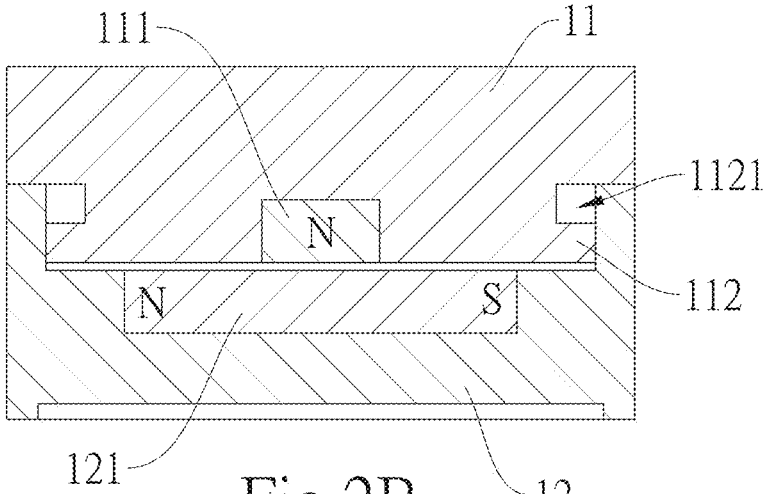
FIG. 2B is sectional view of FIG. 2A of a line X-X.
Figure 3A:
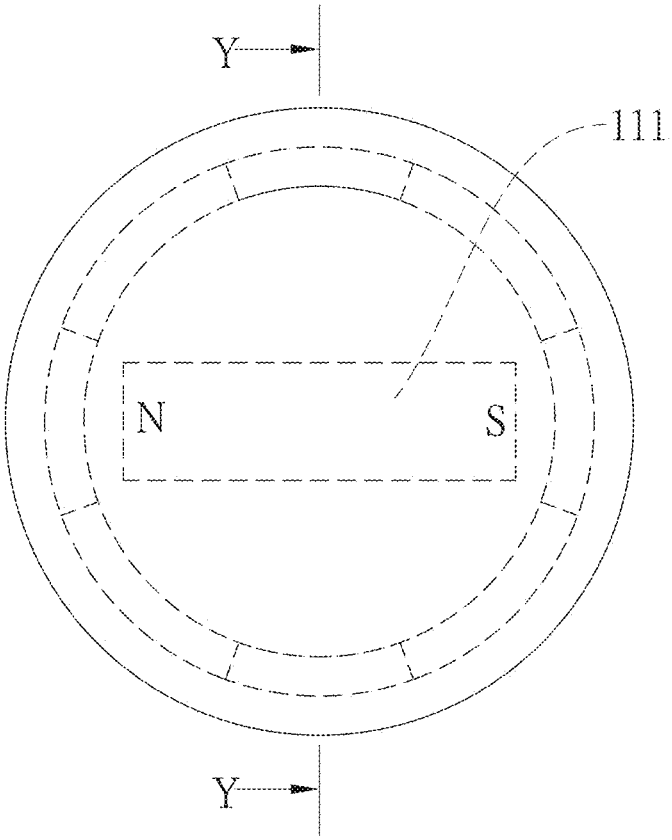
FIG. 3A is a schematic diagram showing an operation of the magnetic assembly structure according to the first embodiment of the present disclosure.
Figure 3B:
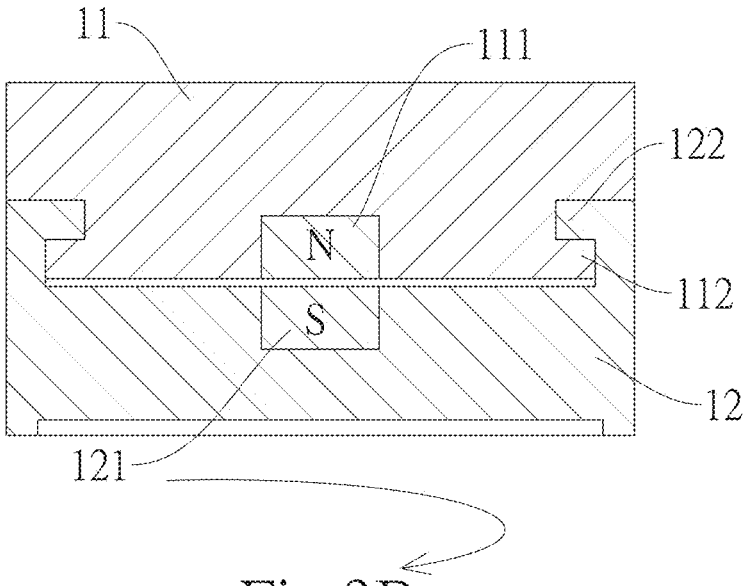
FIG. 3B is sectional view of FIG. 3A of a line Y-Y.

In the first embodiment of the present disclosure, when the user start to make the first main body (11) and the second main body (12) mutually close, the second buckle structure (122) penetrates the notch (1122) and is disposed at the tail terminal of the groove (1121), and the first magnetic component (111) and the second magnetic component (121) are vertical to each other (as shown in FIG. 2A and FIG. 2B). Meanwhile, merely a little force is needed to slightly rotate the first main body (11) or the second main body (12), so as to make the first main body (11) or the second main body (12) be rotated slightly in respect to the rotation axis (A), and then, the N pole of the first main body (11) and the S pole of the second main body (12) generate the magnetic attraction effect, so as to make the first main body (11) or the second main body (12) be automatically rotated in respect to the rotation axis (A), for example, the second buckle structure (122) (i.e. or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other (as shown in FIG. 3A and FIG. 3B).

An N pole direction of the first magnetic component (111) and a S pole direction of the magnetic component (121) are intersected to form an angle (θ), or the first magnetic axis (1111) and the second magnetic axis (1211) are intersected to form the angle (θ), as shown in FIG. 2A. When the first main body (11) and the second main body (12) mutually close, and the angle (θ) is less than 90 degrees but larger than 0 degree, the second buckle structure (122) penetrates the notch (1122) and is disposed at the tail terminal of the groove (1121). Meanwhile, no force for rotating is required, and the first main body (11) and the second main body (12) are mutually and automatically rotated in respect to the rotation axis (A) due to the magnetic attraction effect generated by the N pole of the first magnetic component (111) and the S pole of the second magnetic component (121), for example, the second buckle structure (122) (or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other (as shown in FIG. 3A and FIG. 3B). Of course, the angle (θ) can be larger than 90 degrees, or equal to 90 degrees.

The magnetic assembly structure (1) can has an accommodation space (W), and the first main body (11) and the second main body (12) mutually close to form the accommodation space (W), or alternatively, the second main body (12) has the accommodation space (W), or alternatively, the first main body (11) has the accommodation space (W). In the embodiment, when the first buckle structure (112) and the second buckle structure (122) are engaged to each other, the first buckle structure (112) and the second buckle structure (122) are disposed between the first magnetic component (111) and the second magnetic component (121), or the first buckle structure (112) and the second buckle structure (122) are disposed at the edge of the middle part of the magnetic assembly structure (1).

Figure 4:
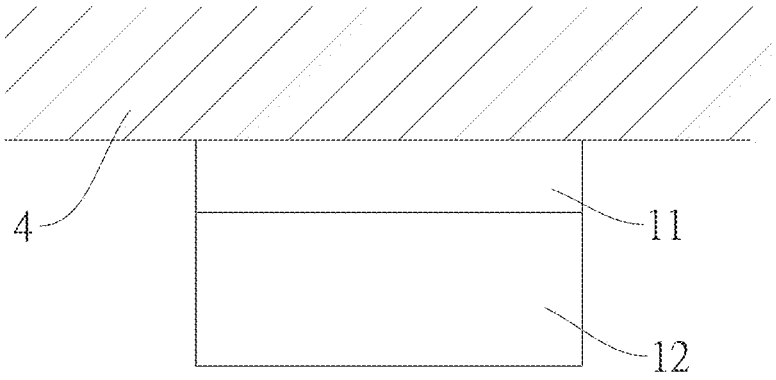
FIG. 4 is a schematic diagram showing an application of a ceiling lamp using the magnetic assembly structure of the present disclosure.
Figure 5:
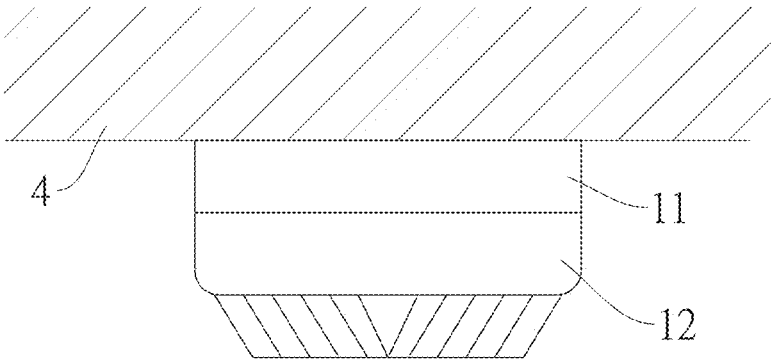
FIG. 5 is a schematic diagram showing an application of a smoke detector using the magnetic assembly structure of the present disclosure.

Refer to FIG. 4 and FIG. 5, which respectively illustrate embodiments of the magnetic assembly structures (1) being applied to a ceiling lamp (FIG. 4) and a smoke detector (FIG. 5). In the embodiment of the magnetic assembly structures (1) being applied to the ceiling lamp, the first main body (1) of the magnetic assembly structure (1) is a lamp case and disposed on the ceiling (4), and the lamp case is installed with an electronic circuit (not shown in drawings) and a lamp bulb (not shown in drawings). The second main body (12) is a lamp mask, and the lamp mask has the accommodation space (W) (as shown in FIG. 1). When installing the ceiling lamp, one user can uses merely one hand to hold the lamp mask, move the lamp mask close to the lamp case, and the lamp case and the lamp mask are mutually and automatically rotated due to the magnetic attraction effect of the magnetic component (111) and the magnetic component (121), so as to make the first buckle structure (112) and the second buckle structure (122) engaged to each other. When removing the lamp mask from the lamp case, the user merely reversely rotate the lamp mask to overcome the magnetic attraction effect of the magnetic component (111) and the magnetic component (121), the lamp mask can be removed from the lamp case without helps of other tool. Thus, when installing and uninstalling the ceiling lamp, no other user's help is required. After assembling the lamp case and the lamp mask, the lamp bulb can be received in the accommodation space (W).

In the embodiment of the magnetic assembly structures (1) being applied to the smoker detector, the first main body (11) of the magnetic assembly structure (1) is a base body being disposed on the ceiling (4). The second main body (12) is the smoke detector, the smoke detector and the base body are mutually and automatically rotated due to the magnetic attraction effect of the magnetic component (111) and the magnetic component (121), so as to make the first buckle structure (112) and the second buckle structure (122) engaged to each other.

It is noted that, the first magnetic component (111) is a magnet or an iron product, the second magnetic component (121) is a magnet or an iron product, and at least one of the first magnetic component (111) and the second magnetic component (121) is magnet, wherein the magnet is a permanent magnet or an electromagnet.

Figure 6A:
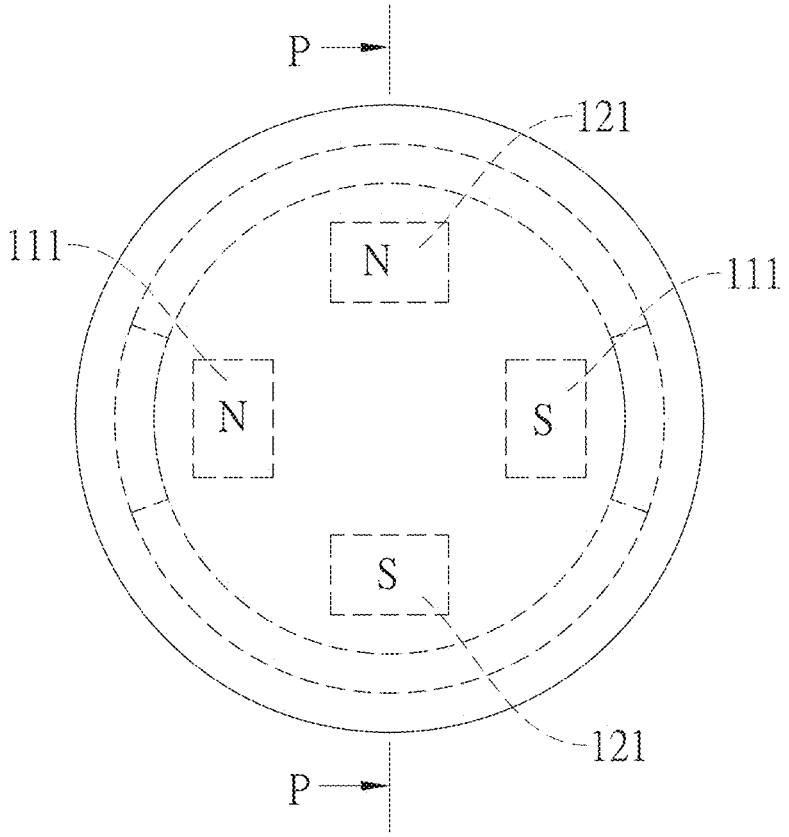
FIG. 6A is a schematic diagram showing the first main body and second main body of the magnetic assembly structure mutually close according to a second embodiment of the present disclosure.
Figure 6B:
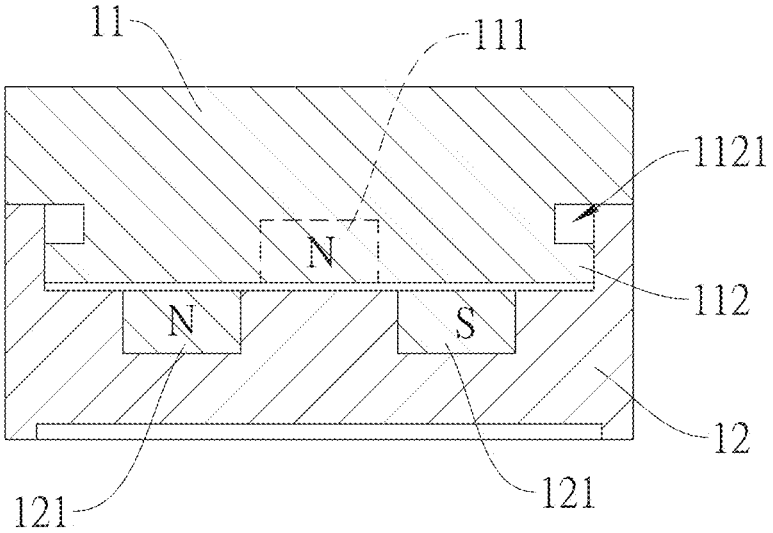
FIG. 6B is sectional view of FIG. 6A of a line P-P.

Furthermore, referring to FIG. 6A, FIG. 6B, FIG. 7A and FIG. 7B simultaneously, which illustrate a second embodiment of the magnetic assembly structure of the present disclosure, the first main body (11) comprises the two first magnetic components (111) and the two first buckle structures (112), wherein the two first magnetic components (111) are symmetrically disposed on the first main body (11), and the two first buckle structures (112) are symmetrically disposed on the first main body (11). The second main body (12) also comprises the two second magnetic components (121) and the two second buckle structures (122), the two second magnetic components (121) are symmetrically disposed on the second main body (12), and the two second buckle structures (122) are symmetrically disposed on the second main body (12). The two first magnetic components (111) are poles of same polarities, for example, both of them are the N poles or the S poles, and the two second magnetic components (121) are poles of same polarities, wherein the polarity of the pole of the first magnetic component (111) is different from that of the second magnetic component (121); or alternatively, the two first magnetic components (111) are poles of different polarities, for example, one is the N pole and another one is the S pole, and the two second magnetic components (121) are poles of different polarities, as shown in FIG. 6A. It is noted the following implementations are also practicable, at least one of the two first magnetic components (111) is a magnet, and at least one of the two second magnetic components (121) is an iron product; or alternatively, at least one of the two second magnetic components (121) is a magnet, and at least one of the two first magnetic components (111) is an iron product.

Figure 7A:
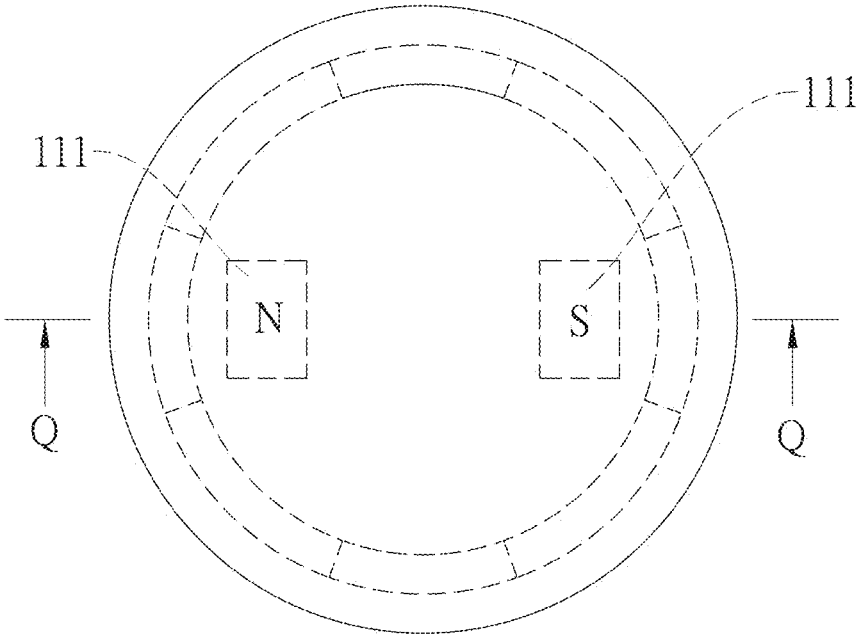
FIG. 7A is a schematic diagram showing an operation of the magnetic assembly structure according to the second embodiment of the present disclosure.
Figure 7B:
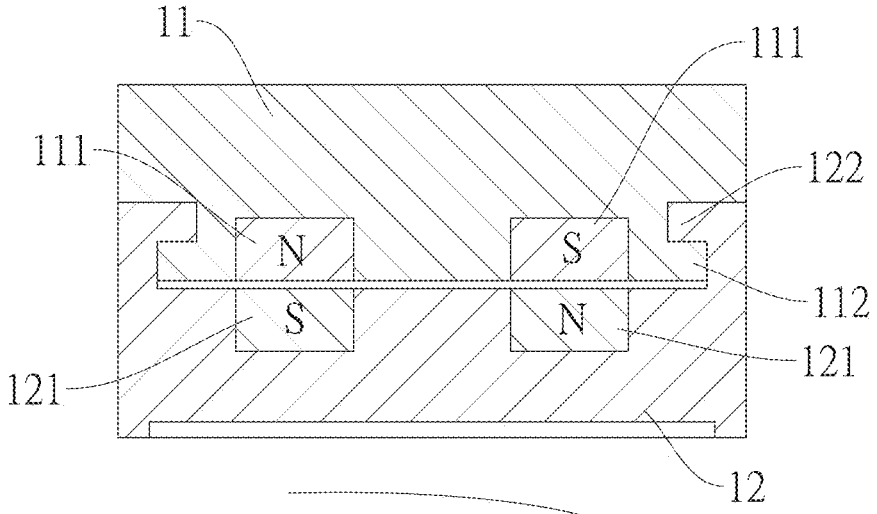
FIG. 7B is sectional view of FIG. 7A of a line Q-Q.
Figure 8:
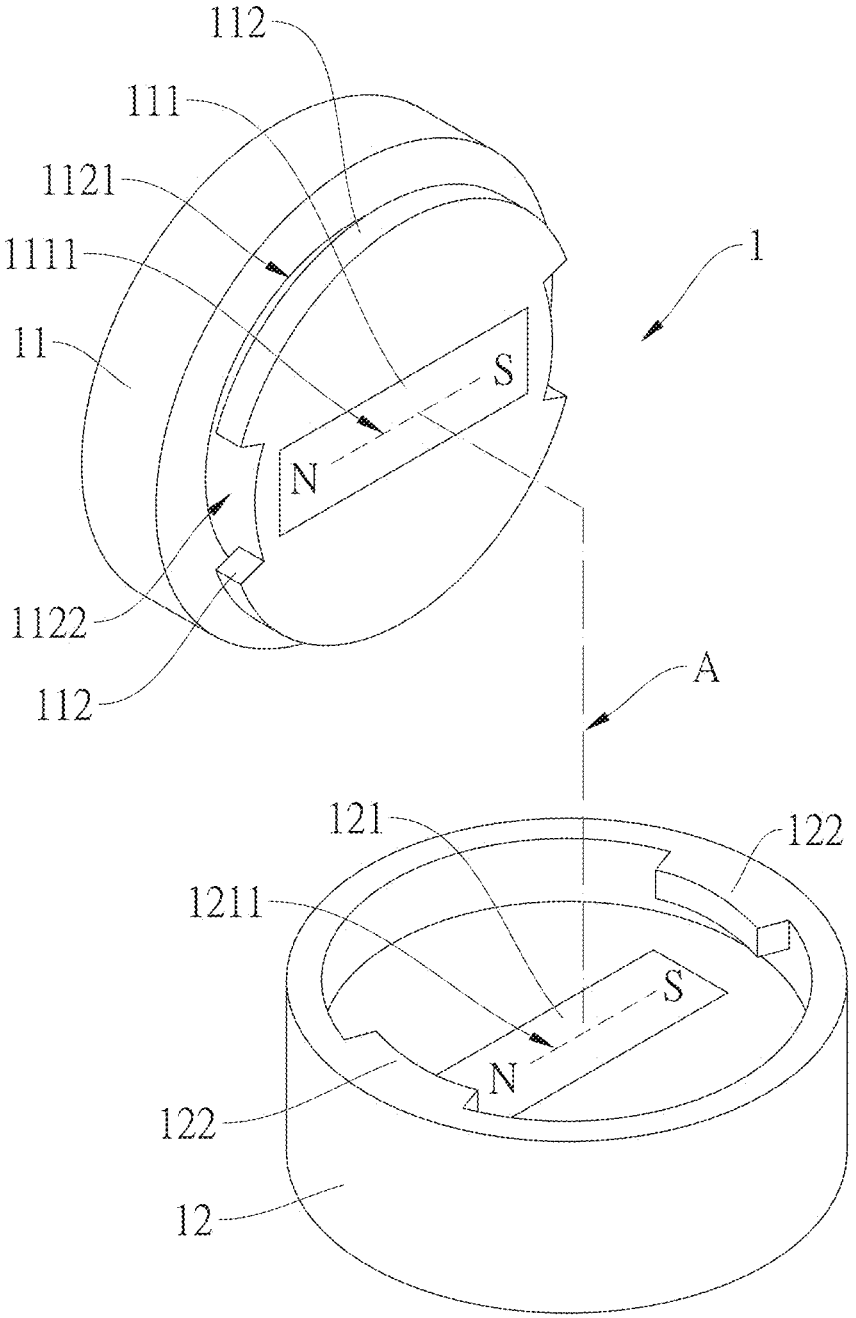
FIG. 8 is an explosive diagram of a magnetic assembly structure according to a third embodiment of the present disclosure.
Figure 9A:
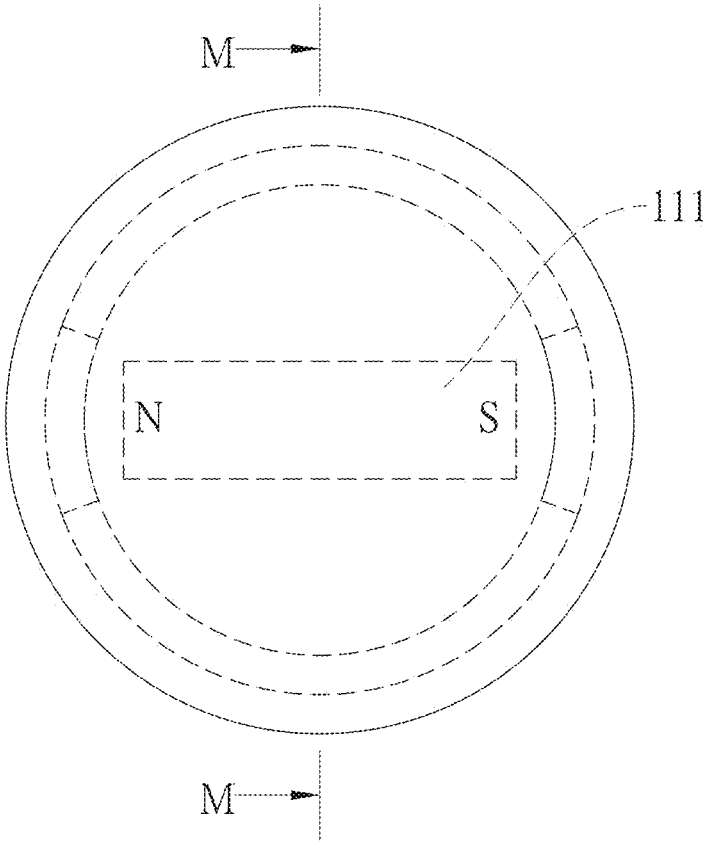
FIG. 9A is a schematic diagram showing the first main body and second main body of the magnetic assembly structure mutually close according to the third embodiment of the present disclosure.
Figure 9B:
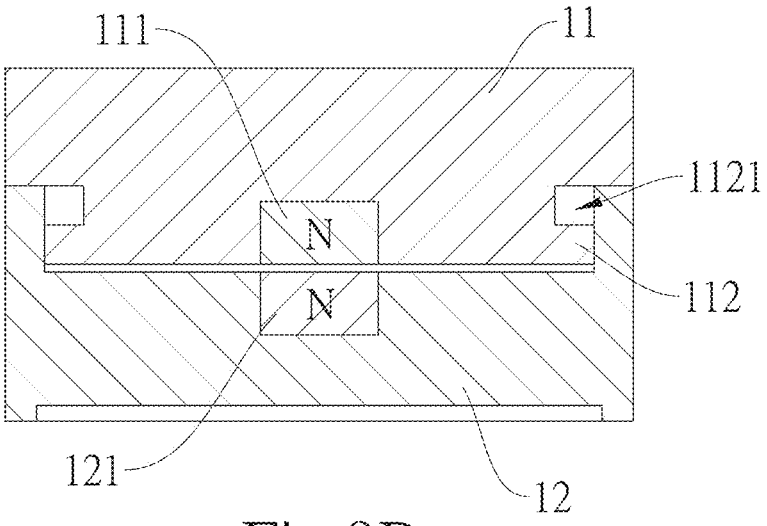
FIG. 9B is sectional view of FIG. 9A of a line M-M.
Figure 10A:
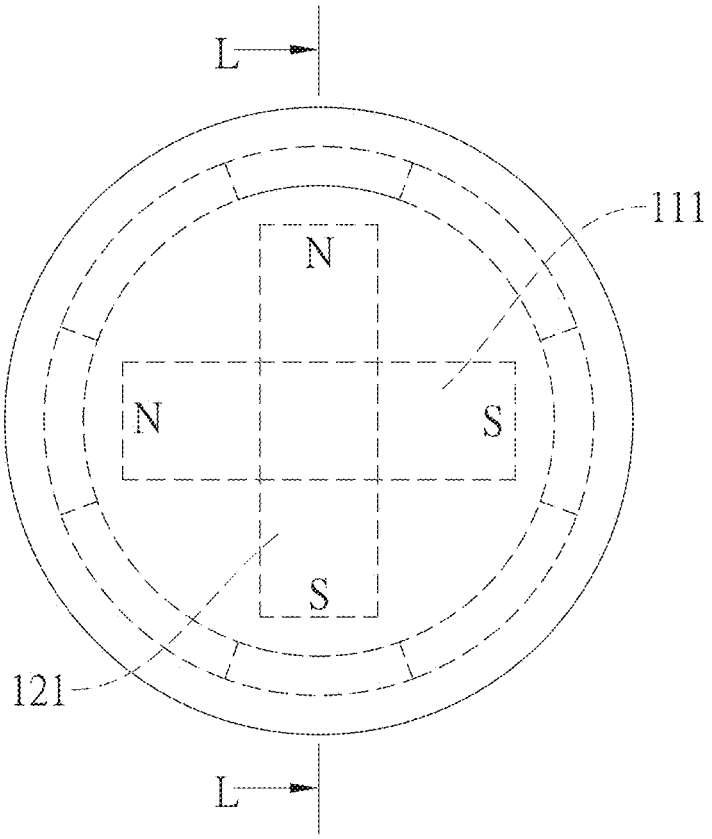
FIG. 10A is a schematic diagram showing an operation of the magnetic assembly structure according to the third embodiment of the present disclosure.
Figure 10B:
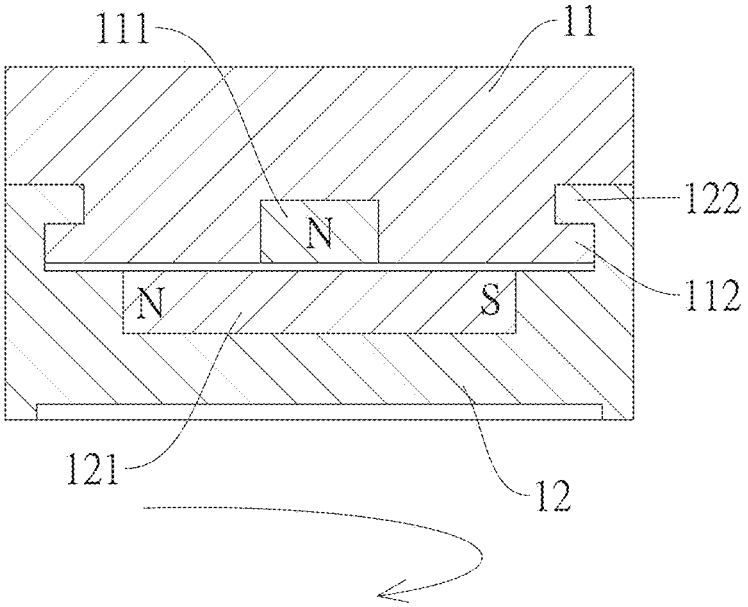
FIG. 10B is sectional view of FIG. 10A of a line L-L.
Figure 11A:
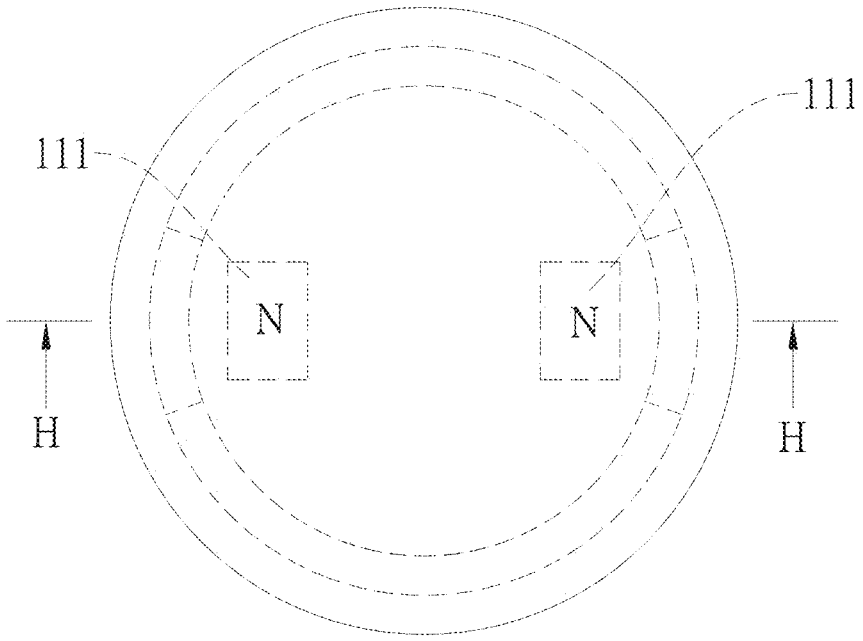
FIG. 11A is a schematic diagram showing the first main body and second main body of the magnetic assembly structure mutually close according to a fourth embodiment of the present disclosure.
Figure 11B:
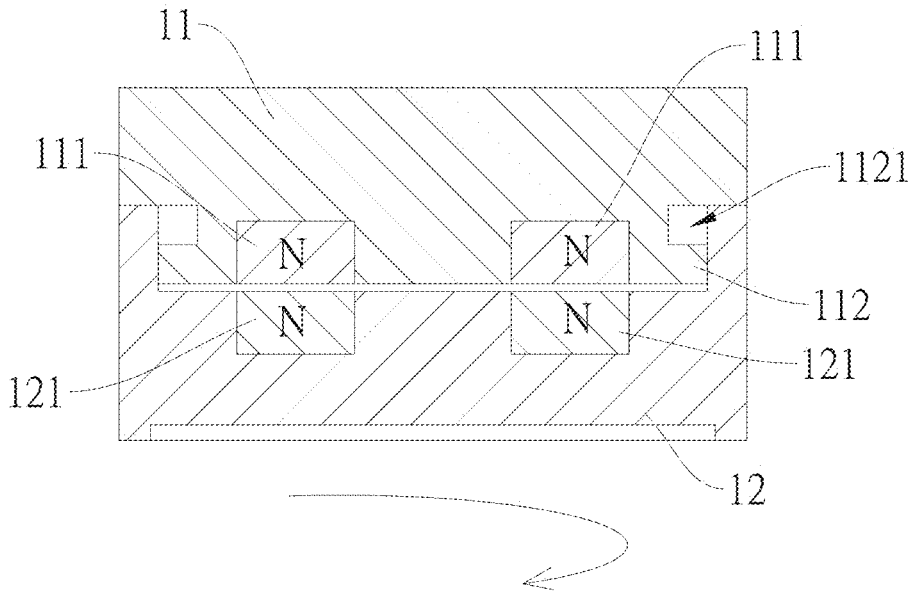
FIG. 11B is sectional view of FIG. 11A of a line H-H.
Figure 12A:
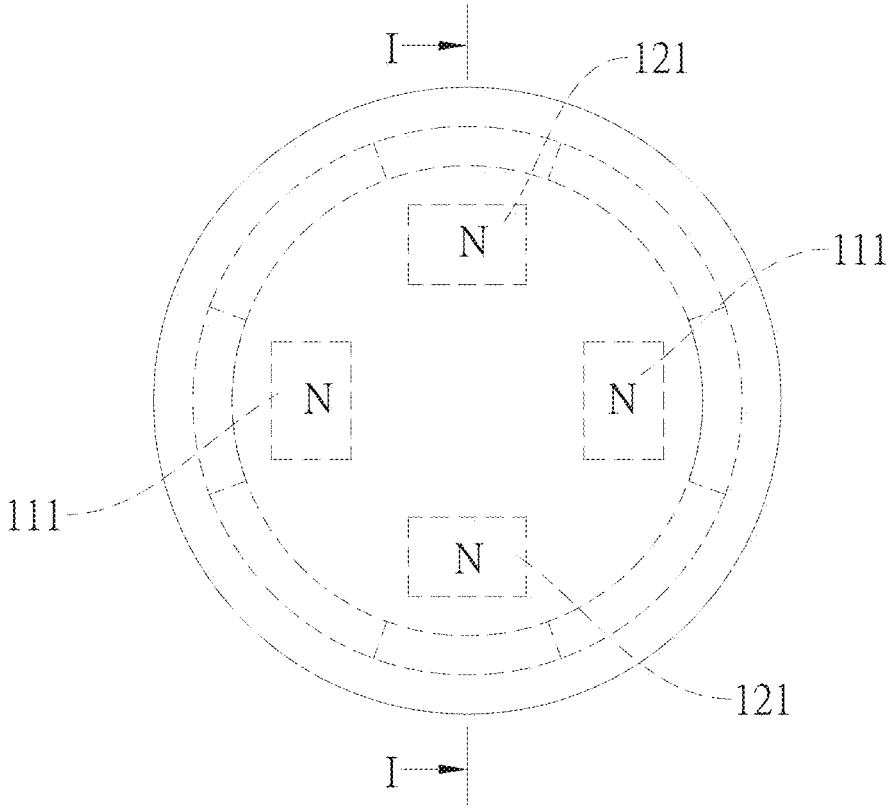
FIG. 12A is a schematic diagram showing an operation of the magnetic assembly structure according to the fourth embodiment of the present disclosure.
Figure 12B:
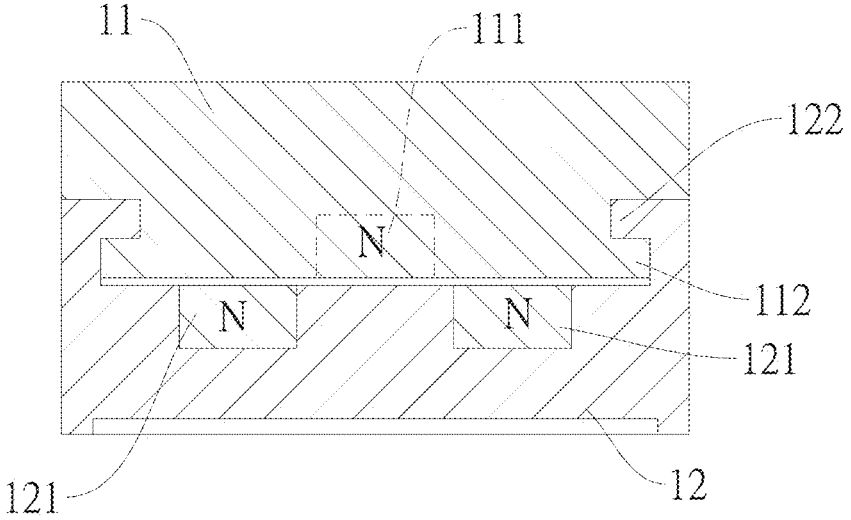
FIG. 12B is sectional view of FIG. 12A of a line I-I.

Referring to FIG. 6A through FIG. 7B again, when the user begin to make the first main body (11) and the second main body (12) mutually close, the operation principle and manner are the same as those of the first embodiment, thus omitting the redundant descriptions. The first main body (11) and the second main body (12) are mutually and automatically rotated due to the magnetic attraction effect generated by the N pole of the first magnetic component (111) and the S pole of the second magnetic component (121), for example, the second buckle structure (122) (or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other.

Next, referring to FIG. 8, FIG. 9A, FIG. 9B, FIG. 10A and FIG. 10B, which illustrate a third embodiment of the magnetic assembly structure of the present disclosure, the third embodiment is similar to the first embodiment, and the differences of the two embodiments are illustrated as follows. The second buckle structure (122) of the second main body (12) in the third embodiment is disposed on one of the front and back sides of the second magnetic component (121), or the second buckle structure (122) is disposed on one of the front and back sides of the second magnetic axis (1211). When the user begin to make the first main body (11) and the second main body (12) mutually close, the second buckle structure (122) penetrates the notch (1122) and is disposed at the tail terminal of the groove (1121), and the first magnetic component (111) and the second magnetic component (121) are parallel to each other, or the N pole direction of the first magnetic component (111) and the N pole direction of the magnetic component (121) are intersected to form a repulsion angle (not shown in the drawings). Meanwhile, no force is needed to rotate the first main body (11) or the second main body (12), the first main body (11) or the second main body (12) are rotated in respect to the rotation axis (A) due to the magnetic repulsion effect generated by the N poles (or S poles) of the first magnetic component (111) and the second magnetic component (121), for example, the second buckle structure (122) (i.e. or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other. The repulsion angle can be larger than or equal to 0 degree, and preferably, the repulsion angle is equal to 0 degree.

Referring to FIG. 11A, FIG. 11B, FIG. 12A and FIG. 12B, which illustrate a fourth embodiment of the magnetic assembly structure of the present disclosure, the fourth embodiment is similar to the second embodiment, and the differences of the two embodiments are illustrated as follows. The two first magnetic components (111) in the fourth embodiment are poles of same polarities, for example, both of them are the N poles or the S poles, and the two second magnetic components (121) are poles of same polarities, wherein the polarity of the pole of the first magnetic component (111) is the same as that of the second magnetic component (121).

In addition, the first buckle structure (112) is further disposed on a top side edge of the first magnetic component (111), and the second buckle structure (122) is further disposed on a top side edge of the second magnetic component (121). When the first buckle structure (112) and the second buckle structure (122) are engaged to each other, the first buckle structure (112) and the second buckle structure (122) are disposed on the top side edges of the first magnetic component (111) and the second magnetic component (121). Further, in one other embodiment, the first buckle structure (112) can be disposed on the bottom side edge of the first magnetic component (111), and the second buckle structure (122) can be disposed on the bottom side edge of the second magnetic component (121). When the first buckle structure (112) and the second buckle structure (122) are engaged to each other, the first buckle structure (112) and the second buckle structure (122) are disposed on the bottom side edges of the first magnetic component (111) and the second magnetic component (121).

Based on the above first through fourth embodiments, the first magnetic component (111) and the second magnetic component (121) of the magnetic assembly structure of the present disclosure can mutually generate the magnetic attraction or repulsion effect, so as to rotate the second main body (12) and the first main body (11) in respect to each other. Therefore, the second buckle structure (122) and the first buckle structure (112) can be engaged to each other.

Based on the above first through fourth embodiments, a fifth embodiment is also provided. The differences of the fifth embodiment and the first through fourth embodiments are illustrated as follows. The second buckle structure (122) of the fifth embodiment is a magnetic component, and the magnetic component is a magnet or an iron product. Thus, the magnetic component (111) and the second buckle structure (122) mutually generate the magnetic attraction or repulsion effect, so as to rotate the second main body (12) and the first main body (11) in respect to each other. Therefore, the second buckle structure (122) and the first buckle structure (112) can be engaged to each other.

Based upon the above fifth embodiment, a sixth embodiment is also provided. The differences of the sixth embodiment and the fifth embodiment are illustrated as follows. The first buckle structure (112) is another magnetic component. Thus, the first buckle structure (112) and the second buckle structure (122) mutually generate the magnetic attraction or repulsion effect, so as to rotate the second main body (12) and the first main body (11) in respect to each other. Therefore, the second buckle structure (122) and the first buckle structure (112) can be engaged to each other.

According to the illustrations of the above embodiments, compared to the prior art, the magnetic assembly structure of the present disclosure has the following advantages. The magnetic assembly structure of the present disclosure, via the hardware design of disposing two magnetic components and buckle structures in the two main bodies, makes the two main bodies mutually rotate in respect to the magnetic components when the two magnetic components are affected by the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced.

To sum up, the magnetic assembly structure provided by the present disclosure has been not anticipated by publications or used in public, which meets patentability of the invention. Examination of the present disclosure is respectfully requested, as well as allowance of the present disclosure.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A magnetic assembly structure, at least comprising:

a first main body, comprising at least one first buckle structure, the first buckle structure is a protrusion edge, and top of the first buckle structure is formed with a groove; and a second main body, comprising at least one second buckle structure, the second buckle structure is a protrusion block, the second buckle structure is accommodated in the groove, and the protrusion block is capable of moving within the groove;

wherein the second main body and the first main body mutually generate a magnetic attraction or repulsion effect, so as to automatically rotate the second main body and first main body in respect to each other, and the second buckle structure is automatically moved forward interior of the groove from a terminal of the groove, so as to engage the protrusion block to the groove, thereby engaging the second buckle structure and the first buckle structure each other.

2. The magnetic assembly structure according to claim 1, wherein the second buckle structure is a magnetic component, and the first buckle structure is another magnetic component, such that the second buckle structure and the first buckle structure mutually generate the magnetic attraction or repulsion effect.

3. The magnetic assembly structure according to claim 1, wherein the first main body further comprises at least one first magnetic component.

4. The magnetic assembly structure according to claim 3, wherein the second buckle structure is a magnetic component, such that the first magnetic component and the second buckle structure mutually generate the magnetic attraction or repulsion effect.

5. The magnetic assembly structure according to claim 3, wherein the second main body further comprises at least one second magnetic component, such that the second magnetic component and the first magnetic component mutually generate the magnetic attraction or repulsion effect.

6. The magnetic assembly structure according to claim 5, wherein the second magnetic component and the first magnetic component mutually generate the magnetic attraction effect.

7. The magnetic assembly structure according to claim 6, wherein the first magnetic component is a magnet or an iron product, the second magnetic component is a magnet or an iron product, and at least one of the first magnetic component and the second magnetic component is magnet, wherein the magnet is a permanent magnet or an electromagnet.

8. The magnetic assembly structure according to claim 6, wherein an N pole and a S pole of the first magnetic component are respectively disposed on two ends of the first magnetic component, an N pole and a S pole of the second magnetic component are respectively disposed on the two ends of the second magnetic component; therefore, when the first main body and the second main body mutually close, an N pole direction of the first magnetic component and a S pole direction of the magnetic component are intersected to form an angle, wherein the angle is larger than 90 degrees, equal to 90 degrees or less than 90 degrees but larger than 0 degree.

9. The magnetic assembly structure according to claim 8, wherein the angle is less than 90 degrees but larger than 0 degree.

10. The magnetic assembly structure according to claim 5, wherein the first main body and the second main body are rotated in respect to each other via a rotation axis.

11. The magnetic assembly structure according to claim 10, wherein the rotation axis is a connection line of a central of the first magnetic component and a central of the second magnetic component, a central of the first main body, a central of the second main body or a connection line of the central of the first main body and the central of the second main body.

12. The magnetic assembly structure according to claim 5, wherein the first main body comprises the two first magnetic components.

13. The magnetic assembly structure according to claim 12, wherein the second main body comprises the two second magnetic components.

14. The magnetic assembly structure according to claim 13, wherein the two first magnetic components are poles of same polarities, the two second magnetic components are poles of same polarities, wherein the polarity of the pole of the first magnetic component is different from that of the second magnetic component; or alternatively, the two first magnetic components are poles of different polarities, and the two second magnetic components are poles of different polarities.

15. The magnetic assembly structure according to claim 13, wherein at least one of the two first magnetic components is a magnet, and at least one of the two second magnetic components is an iron product; or alternatively, at least one of the two second magnetic components is a magnet, and at least one of the two first magnetic components is an iron product.

16. The magnetic assembly structure according to claim 5, wherein the second magnetic component and the first magnetic component mutually generate the magnetic repulsion effect.

17. The magnetic assembly structure according to claim 16, wherein an N pole and a S pole of the first magnetic component are respectively disposed on two ends of the first magnetic component, an N pole and a S pole of the second magnetic component are respectively disposed on the two ends of the second magnetic component; therefore, when the first main body and the second main body mutually close, an N pole direction of the first magnetic component and an N pole direction of the magnetic component are intersected to form a repulsion angle, wherein the repulsion angle is larger than or equal to 0 degree.

18. The magnetic assembly structure according to claim 16, wherein the first main body comprises the two first magnetic components.

19. The magnetic assembly structure according to claim 18, wherein the second main body comprises the two second magnetic components.

20. The magnetic assembly structure according to claim 19, wherein the poles of the two first magnetic components and also the second magnetic component are all the same polarity.

21. The magnetic assembly structure according to claim 1, wherein a terminal of the first buckle structure is formed with a notch, and the groove communicates with the notch, and the second buckle structure penetrates the notch.

22. The magnetic assembly structure according to claim 1, wherein the first main body comprises two first buckle structures, and the two first buckle structures are respectively and symmetrically disposed at a left and right sides of the first magnetic component.

23. The magnetic assembly structure according to claim 1, wherein the second main body comprises two second buckle structures, and the two second buckle structures are respectively and symmetrically disposed at a left and right sides of the second magnetic component.

* * * * *